US009856613B2

(12) United States Patent
Berning et al.

(10) Patent No.: US 9,856,613 B2
(45) Date of Patent: Jan. 2, 2018

(54) SELF-PROPELLED ROAD MILLING MACHINE

(71) Applicant: Wirtgen GmbH, Windhagen (DE)

(72) Inventors: Christian Berning, Zulpich (DE); Dieter Bungarten, Neustadt (DE); Peter Busley, Linz (DE); Marius Kloft, Koblenz (DE)

(73) Assignee: Wirtgen GmbH (DE)

( * ) Notice: Subject to any disclaimer, the term of this patent is extended or adjusted under 35 U.S.C. 154(b) by 142 days.

(21) Appl. No.: 14/925,560

(22) Filed: Oct. 28, 2015

(65) Prior Publication Data

US 2016/0130772 A1 May 12, 2016

(30) Foreign Application Priority Data

Nov. 11, 2014 (DE) ..... 10 2014 016 587

(51) Int. Cl.
*E01C 23/088* (2006.01)
*E01H 1/05* (2006.01)
*E01C 23/12* (2006.01)

(52) U.S. Cl.
CPC ..... *E01C 23/088* (2013.01); *E01C 23/127* (2013.01); *E01H 1/053* (2013.01)

(58) Field of Classification Search
CPC ..... E01C 23/088; E01C 23/127
See application file for complete search history.

(56) References Cited

U.S. PATENT DOCUMENTS 2,996,742 A * 8/1961 Aimers ..... E01H 1/053 15/87
4,335,482 A 6/1982 Jones
(Continued)

FOREIGN PATENT DOCUMENTS

DE 8709504 U1 11/1987
DE 4319729 A1 12/1993
(Continued)

OTHER PUBLICATIONS

European Search Report in corresponding European Patent Application No. EP 15 18 9827, dated Apr. 12, 2016, 2 pp (not prior art).

*Primary Examiner* — John J Kreck
(74) *Attorney, Agent, or Firm* — Lucian Wayne Beavers; Patterson Intellectual Property Law, PC

(57) ABSTRACT

The road milling machine according to the invention comprises a cleaning device which has a cleaning unit arranged in front of the work roller in the working direction. The cleaning unit ensures that the surface of the terrain over which the wheels or running gears travel is clear of material. As a result, an optimum milling result is always achieved. The invention takes effect in particular when using small millers which have at least one rear wheel or running gear which can be moved into an inner working position in relation to a longitudinal side of the machine frame and into an outer working position in relation to a longitudinal side of the machine frame. In this preferred embodiment, the cleaning device comprises a pivot device which is designed in such a way that the cleaning unit can be moved into an inner working position in relation to a longitudinal side of the machine frame and into an outer working position in relation to a longitudinal side of the machine frame. In the inner or outer working position, the cleaning unit is arranged on the same track as the rear wheel or running gear which can be moved into the inner or outer working position. This ensures that the track of the rear wheel or running gear is clear of milled material or other dirt, wherein the cleaning unit does not protrude too far beyond the rear wheel or running gear.

15 Claims, 6 Drawing Sheets

(56) References Cited

U.S. PATENT DOCUMENTS

| | | | | | |
|---|---|---|---|---|---|
| 4,368,554 | A * | 1/1983 | Mealing | E01H 1/047 | 15/340.3 |
| 4,557,010 | A * | 12/1985 | Rosseau | E01H 1/053 | 15/83 |
| 4,561,145 | A | 12/1985 | Latham | | |
| 4,754,521 | A * | 7/1988 | Zoni | E01H 1/042 | 15/340.1 |
| 6,106,073 | A * | 8/2000 | Simons | E01C 23/088 | 180/209 |

FOREIGN PATENT DOCUMENTS

| | | | | |
|---|---|---|---|---|
| DE | 19631042 | A1 | 2/1998 | |
| DE | 102009060719 | A1 | 6/2011 | |
| DE | 102013005594 | A1 | 10/2014 | |
| GB | 190923924 | A * | 0/1910 | E01C 23/088 |

* cited by examiner

SELF-PROPELLED ROAD MILLING MACHINE

BACKGROUND OF THE INVENTION

1. Field of the Invention

The invention relates to a self-propelled road milling machine which comprises a machine frame which is supported by a chassis and a working device having a work roller which comprises work tools, wherein the chassis of the road milling machine comprises two rear wheels or running gears and at least one front wheel or running gear.

2. Description of the Prior Art

A road milling machine having a milling roller arranged at the rear of the machine and a chassis which comprises two rear wheels and two front wheels is known from DE 196 31 042 A1 (U.S. Pat. No. 6,106,073A). The milling roller is arranged between the rear wheels. In the known road milling machine, one of the two rear wheels can be pivoted out of an outer position in relation to a longitudinal side of the machine frame, which position corresponds to the normal position, and into an inner position in relation to the longitudinal side of the machine frame. When the rear wheel is in the inner position, the milling roller of the milling machine can move closely past an obstacle since the rear wheel does not laterally protrude beyond the milling roller in this position.

The material removed by the milling tools of the milling roller as the road milling machine advances is picked up by a transport device so that the material can be loaded onto a lorry. However, the transport device cannot pick up all of the material removed, and therefore material is left lying on the terrain.

The milled material left lying on the terrain could subsequently be removed by means of a sweeping machine. Attempts have also been made to pick up the material using a sweeping device which is fixed to the milling machine and has a rotating roller brush arranged behind the milling roller in the working direction. However, until now equipping milling machines with a sweeping device has been disregarded since it is more cost-effective to use a separate sweeping machine. Until now, experts have seen no reason to clean the surface of the terrain in front of a road milling machine and over which the road milling machine travels. Thus milling machines having a sweeping device have not gained currency either.

The problem when using the known road milling machines is that, in particular in small millers due to the small milling width, the road surface has to be milled off in a plurality of closely adjacent milling steps. When the road surface is milled off by the road milling machines, in particular small millers, in a plurality of milling sections, in certain cases an optimum milling result is not achieved.

SUMMARY OF THE INVENTION

Therefore, the object of the invention is to further improve the milling result when using a road milling machine, in particular a small miller.

This object is achieved according to the invention by the features of the independent claim. The dependent claims concern advantageous embodiments of the invention.

The road milling machine according to the invention comprises a cleaning device which has a cleaning unit arranged in front of the work roller in the working direction. In this context, a cleaning unit is understood to be any means which can be used to remove, for example sweep or brush away, material from a surface. Use of the cleaning device is advantageous in particular in small millers which have two rear wheels or running gears and one front wheel or running gear or two front wheels or running gears, wherein the work roller is arranged between the rear wheels or running gears.

If the road surface is milled off in a plurality of adjacent milling sections, one of the wheels or running gears of the road milling machine unavoidably travels in a previously milled track, in which there may still be removed material. If the wheels or running gears travel over the milled material in the previous milling track, the height of the work roller changes relative to the ground. In practice, it has been shown that this unevenness, even if only small, can be transferred to the subsequent milling track. Although the known road milling machines generally have a device for compensating differences in height between the left-hand and right-hand wheels or running gears, which can be at different heights, for example in the previous milling track and on the road surface yet to be milled off, the known devices can compensate the small differences in height resulting from milling material lying in the milling track either only to an insufficient extent or not at all. The cleaning unit arranged in front of the work roller then ensures that the surface of the terrain over which the wheels or running gears travel is clear of material. As a result, an optimum milling result is always achieved. The milled material thrown up in the previous milling step can be moved by means of the cleaning unit into the region which is milled in the subsequent milling step, after which the milled material is then picked up by means of the transport device so that it can be loaded.

The invention takes effect in particular when using small millers which have at least one rear wheel or running gear which can be moved into an inner working position in relation to a longitudinal side of the machine frame and into an outer working position in relation to a longitudinal side of the machine frame. In this preferred embodiment, the cleaning device comprises a pivot device which is designed in such a way that the cleaning unit can be moved into an inner working position in relation to a longitudinal side of the machine frame and into an outer working position in relation to a longitudinal side of the machine frame. In the inner or outer working position, the cleaning unit is preferably substantially arranged on the same track as the at least one rear wheel or running gear which can be moved into the inner or outer working position. This ensures that the track of the rear wheel or running gear is clear of milled material or other material, wherein the cleaning unit does not laterally protrude too far beyond the rear wheel or running gear. In the small millers, in which the milling roller is arranged between the rear wheels or running gears, terrain unevenness resulting from material lying in the track of the at least one front wheel or running gear does not affect the milling result since by lifting the front wheels or running gears the milling depth is not changed. In a small miller, lifting the front part of the machine frame substantially only causes the machine frame to pivot about an axis on which the rear wheels and the milling roller are arranged.

A further preferred embodiment provides that the pivot device is designed in such a way that, in the outer working position, the cleaning unit is arranged in the working direction between the at least one front wheel or running gear and the rear wheels or running gears, and therefore the milled material can be swept inwards into the central region of the machine where it can be picked up in the subsequent milling step. In the preferred embodiment, in the inner working position the cleaning unit is arranged in the working direction in front of the at least one front wheel or running gear, and therefore the cleaning unit does not laterally protrude.

The pivot device is preferably designed in such a way that, in the inner and/or outer working position, the cleaning unit is floatingly mounted such that it rests on the terrain with a predetermined contact force. This ensures that the cleaning unit can follow uneven ground.

A further preferred embodiment provides an idle position, in which the cleaning unit does not rest on the terrain, for when the cleaning unit is not required.

The working width of the cleaning unit should be at least as wide as the at least one wheel or running gear which can be moved into the inner or outer working position, so as to be able to clean the entire width of the track. The cleaning unit is preferably a sweeping unit which preferably comprises a disc brush which can rotate about an axis of rotation and the working angle of which can preferably be set about at least one axis. The rotating disc brush should be used such that it detects the milled material on the front thereof in the working direction and moves it inwards.

In a road milling machine, in which the right-hand rear wheel or running gear in relation to the working direction can be moved into both the inner and outer working position, in the outer working position, the cleaning unit is arranged in the working direction on the right-hand side of the machine frame behind the at least one front wheel or running gear and in front of the rear wheels or running gears. In this case, the disc brush preferably rotates anti-clockwise, and therefore the milled material is swept inwards. In the inner working position, the cleaning unit is arranged in the working direction in front of the at least one front wheel or running gear on the right-hand side of the longitudinal axis of the road milling machine, wherein the disc brush rotates anti-clockwise, and therefore the milled material is again swept inwards. Since the cleaning unit is arranged on the right-hand side of the milling machine, the cleaning unit can clean the track of the right-hand wheel which is in contact with the ground that has already been milled. However, it is also possible for the left-hand wheel or running gear in the working direction to be the pivotable rear wheel or running gear. The cleaning unit is then accordingly arranged on the other side of the machine and the direction of rotation is reversed.

The height of the rear wheels or running gears of the road milling machine can preferably be adjusted relative to the machine frame. The height of the rear wheels or running gears is preferably adjusted by means of lifting devices, for example lifting cylinders, attached to the machine frame. However, the height of the front wheels or running gears can also be adjusted.

The pivot device can have hydraulic and/or pneumatic and/or electric motor-driven drive means. The pivot device preferably comprises hydraulic drive means. The drive means can be actuated fully automatically by means of a control unit for the purpose of moving the cleaning unit into the individual positions. For this purpose, the vehicle driver can operate a switch or pushbutton. However, it is also possible to manually control the drive means of the cleaning unit in order to move the cleaning unit.

The pivot device preferably comprises two pivot arms so as to be able to move the cleaning unit. In this embodiment, the cleaning unit can be moved into an idle position in which it rests closely against the machine frame. The first end of the first pivot arm can be attached to a first attachment part of the machine frame such that it can pivot about a vertical axis, and the first end of the second pivot arm is arranged on the second end of the first pivot arm such that it can pivot about a horizontal axis, wherein the cleaning unit is arranged on the second end of the second pivot arm such that it can pivot about a horizontal axis. The first attachment part on the machine frame is preferably arranged in the front region of the frame. In a more preferred embodiment of the road milling machine, the attachment part is arranged in the front corner region of the machine frame, preferably on the right-hand side in the working direction, on which side the wheel or running gear which can be moved into the two working positions is also located.

A more preferred embodiment of the pivot device provides a lever mechanism which can be used to achieve uniform movement of the cleaning unit into the individual positions. In this embodiment, the pivot device comprises a first steering arm, the first end of which is rotatably attached to the first pivot arm, and the second end of which is rotatably connected to the first end of a second steering arm, the second end of which second steering arm is rotatably attached to a second attachment part on the second end of the first pivot arm.

In this embodiment, the drive means of the pivot device are a piston/cylinder arrangement, the first end of which is rotatably connected to the second end of the first steering arm and to the first end of the second steering arm, and the second end of which is rotatably attached to the second attachment part. However, the drive means may also be a linear unit.

BRIEF DESCRIPTION OF THE DRAWINGS

An embodiment of the invention is explained in more detail hereinafter with reference to the drawings, in which.

DETAILED DESCRIPTION

Figure 1:
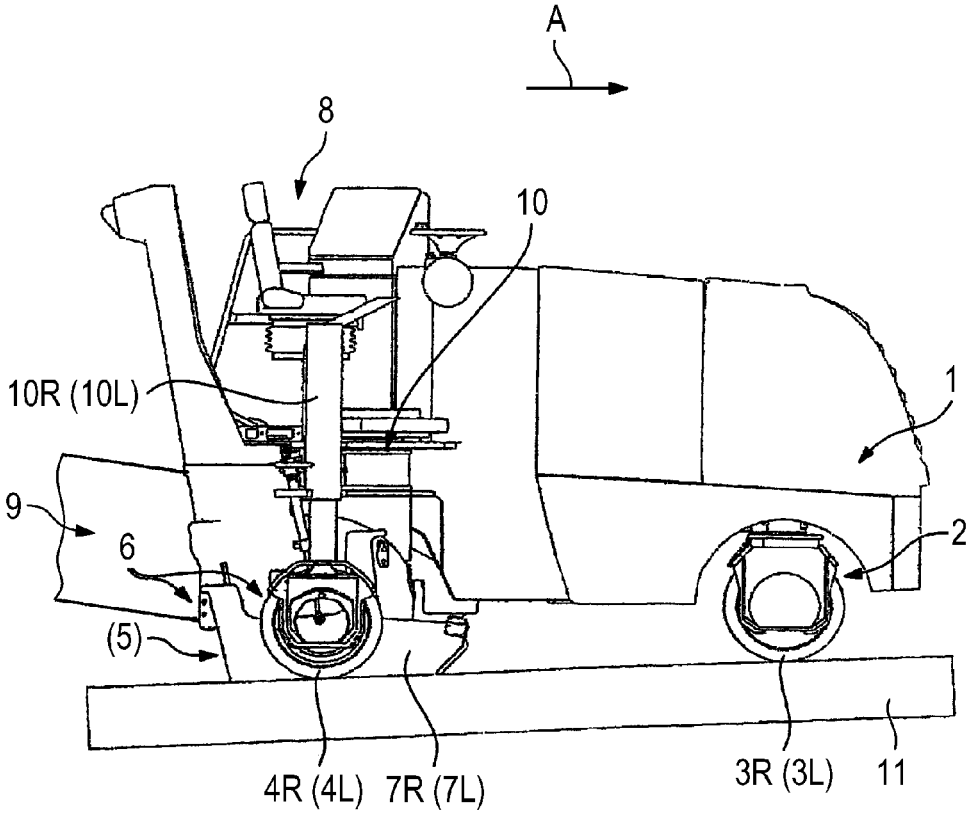
FIG. 1 is a side view of a road milling machine.
Figure 2:
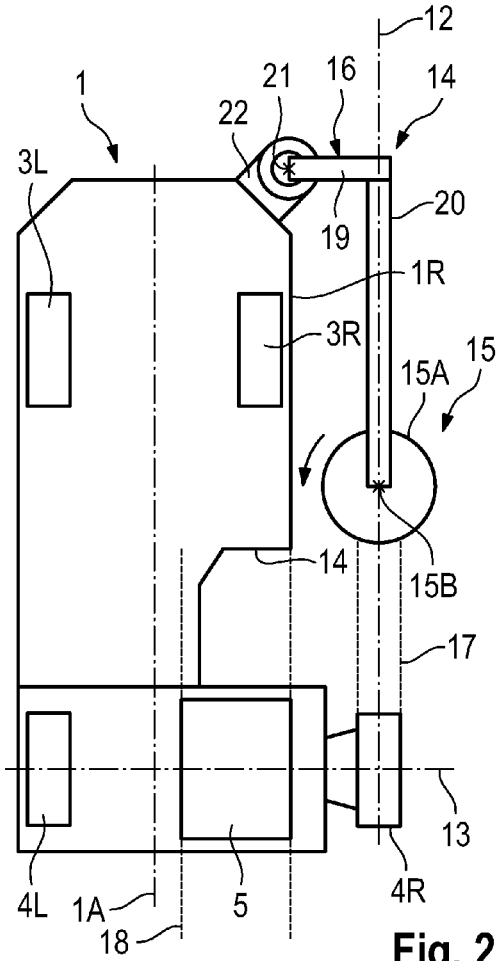
FIG. 2 is a simplified schematic plan view of the road milling machine in FIG. 1, wherein the cleaning unit is in the outer working position.

FIG. 1 is a side view of an embodiment of a road miller, in this case a small miller. The road miller comprises a machine frame 1 which is supported by a chassis 2. The chassis 2 comprises in the working direction A a front right-hand wheel 3R and a front left-hand wheel 3L and a rear right-hand wheel 4R and a rear left-hand wheel 4L. However, caterpillar tracks may also be provided in place of wheels. The wheels or caterpillar tracks may be referred to as ground engaging supports.

The road miller comprises a working device having a work roller (5) which is a milling roller equipped with milling tools. The milling roller (5) is arranged in a milling roller housing 6 which is closed by an edge protector 7R (7L) on both the left-hand and right-hand side in the working direction A. The operator's platform 8 is arranged above the milling roller housing 6. A transport device 9 (only shown in part) is arranged at the rear of the road miller, behind the milling roller (5) in the working direction A, and comprises a conveyor belt which is used to carry away the material removed by the milling tools in the milling roller housing 6.

The road miller further comprises a device 10 for lifting or lowering the rear left-hand and right-hand wheels 4R, (4L), which rest on the ground, relative to the machine frame 1. The device 10 for lifting or lowering wheels comprises a lifting device 10R associated with the right-hand wheel 4R and a lifting device (10L) associated with the left-hand wheel (4L). In order to set the milling depth, the height of the rear wheels is adjusted relative to the machine frame 1, and therefore the milling roller (5) can penetrate the ground material 11.

FIGS. 2 to 5 are simplified schematic views of the road miller in FIG. 1, wherein corresponding parts are provided with the same reference signs. In the road miller, the right-hand rear wheel 4R in the working direction A is pivotally mounted. The rear right-hand wheel 4R can be moved out of an outer working position in relation to the right-hand longitudinal side 1R of the machine frame 1 into an inner working position in relation to the right-hand longitudinal side 1R of the machine frame 1. In the outer working position shown in FIG. 2, the two rear wheels 4R, 4L are located on a common axis 13, wherein the milling roller 5 is arranged between the rear wheels 4R, 4L with its axis substantially in the same vertical plane as the rear wheels. In the inner working position, the rear right-hand wheel 4R is arranged in front of the milling roller 6 in the working direction A in a recess 14 in the machine frame 1. In this working position, the right-hand rear wheel 4R does not laterally protrude beyond the right-hand edge of the milling roller 6, and therefore the milling roller of the road miller can move closely past obstacles. The pivot mechanism for the rear wheel is described in detail in DE 196 31 042 A1 (U.S. Pat. No. 6,106,073A) for example.

Figure 3:
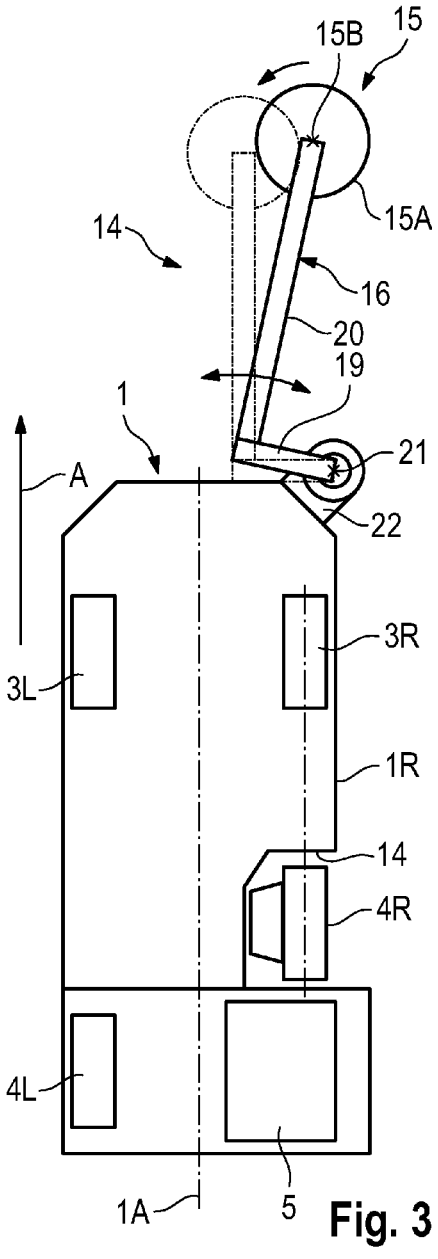
FIG. 3 shows the road milling machine, wherein the cleaning unit is in the inner working position.
Figure 4:
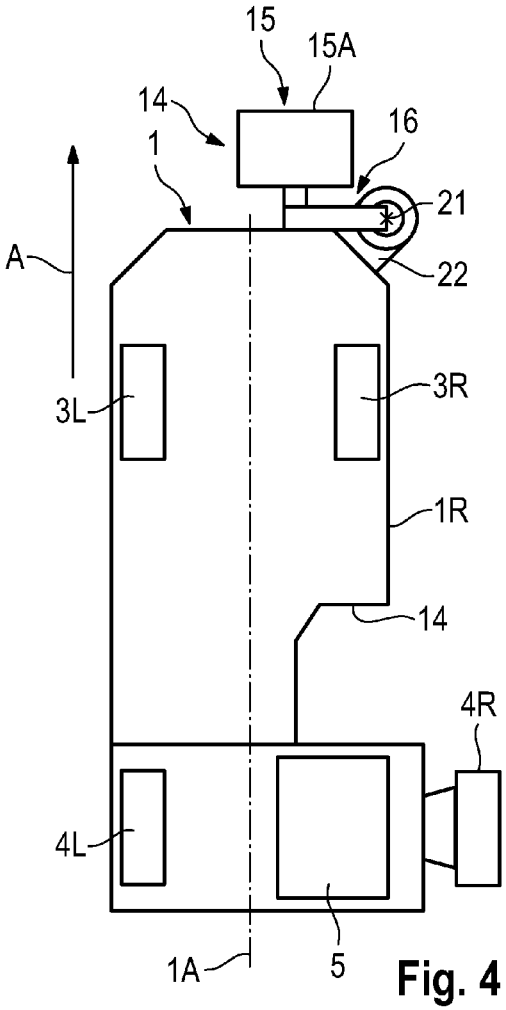
FIG. 4 shows the road milling machine, wherein the cleaning unit is in the idle position and the right-hand rear wheel is in the outer working position.
Figure 5:
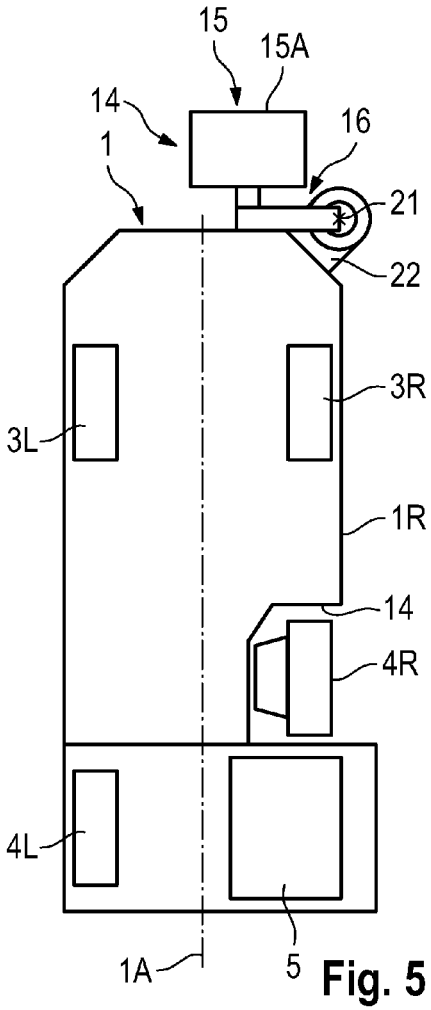
FIG. 5 shows the road milling machine, wherein the cleaning unit is in the idle position and the right-hand rear wheel is in the inner working position.

The road miller comprises a cleaning device 14 which is only shown schematically in FIGS. 2 to 5. The cleaning device 14 comprises a cleaning unit 15 which can be moved by means of a pivot device 16. The cleaning device 14 may be referred to as a cleaning assembly 14, and the cleaning unit 15 may also be referred to as a cleaning tool 15. The pivot device 16 may be referred to as a pivot assembly 16. In the present embodiment, the cleaning unit 15 is a sweeping unit which has a disc brush 15A. The pivot device 16 allows for the cleaning unit 15 to be moved into an outer working position, shown in FIG. 2, and into an inner working position, shown in FIG. 3. In addition, the cleaning unit 15 can be moved into an idle position which is shown in FIGS. 4 and 5.

In the outer position, the disc brush 15A of the cleaning unit 15 is arranged in the working direction A on the right-hand side of the machine, to the side of the outer right-hand edge of the machine frame 1, between the front and rear wheels 3L, 3R, 4L, 4R. The axis of rotation 15B of the disc brush 15A and the right-hand rear wheel 4R are arranged on a common axis 12 which extends in parallel with the longitudinal axis 1A of the machine frame 1, and therefore the disc brush 15A is located in the track of the rear wheel 4R. Since the working region of the disc brush 15A, which is determined by the diameter of the disc brush, is larger than the width of the rear wheel 4R, the entire width of the track 17 of the rear wheel 4R is cleaned. In small millers of which the milling roller is arranged between the rear wheels, the track of the front wheel does not need to be cleaned since the front wheels lifting due to material lying in the track does not affect the milling result.

If a road miller is used to machine a large surface area in a plurality of work steps, the right-hand rear wheel 4R is located in the milling track of the previous milling step, while the left-hand rear wheel 4L is in contact with the ground that is yet to be milled. The height offset between the left-hand and right-hand side is compensated by the left-hand lifting device 10L being retracted and the right-hand lifting device 10R being extended. Since the right-hand milling track is clear of milled material or other dirt, the milling roller 5 always stays at the correct height with regard to the surface of the road surface to be machined as the machine advances. The road miller is also unable to carry out lateral tilt movements because of unevenness due to milled material which could be located in the right-hand milling track.

In the inner working position, the disc brush 15A of the cleaning unit 15 is arranged in front of the front wheels 3L, 3R in the working direction A. The cleaning unit 15 assumes this position when the right-hand rear wheel 4R is in the inner working position. In this position, the axis of rotation 15B of the disc brush 15A and the rear wheel 4R are once again arranged on a common longitudinal axis which extends in parallel with the longitudinal axis 1A of the construction machine, and therefore the disc brush is once again located in the track of the rear wheel 4R which is henceforth pivoted inwards. In the present embodiment, the geometric dimensions of the machine require the disc brush 15A to be pivoted slightly outwards in the inner working position in order to align the disc brush with the rear wheel. This position is shown in FIG. 3 by solid lines.

In the idle position, the pivot device 16 is folded up so that it requires less space. It is then arranged on the front of the road miller (FIGS. 4 and 5).

In the present embodiment, the pivot device 16 comprises hydraulic drive means (not shown in FIGS. 2 to 5). The drive means of the pivot device 16 are actuated in such a way that, in the inner and the outer working position, the disc brush 15A is floatingly mounted such that it rests on the ground with a specific contact force. A floating mounting of this type is known from the prior art.

The disc brush 15A rotates anti-clockwise in the outer and inner working position. In the outer working position, the material thrown up in the previous milling step is swept to the left-hand side in front of the milling roller 5 in the working direction A by the disc brush 15A arranged between front and rear wheels 3L, 3R, 4L, 4R, and therefore the material lies in the milling track 18 of the subsequent milling step.

Figure 6:
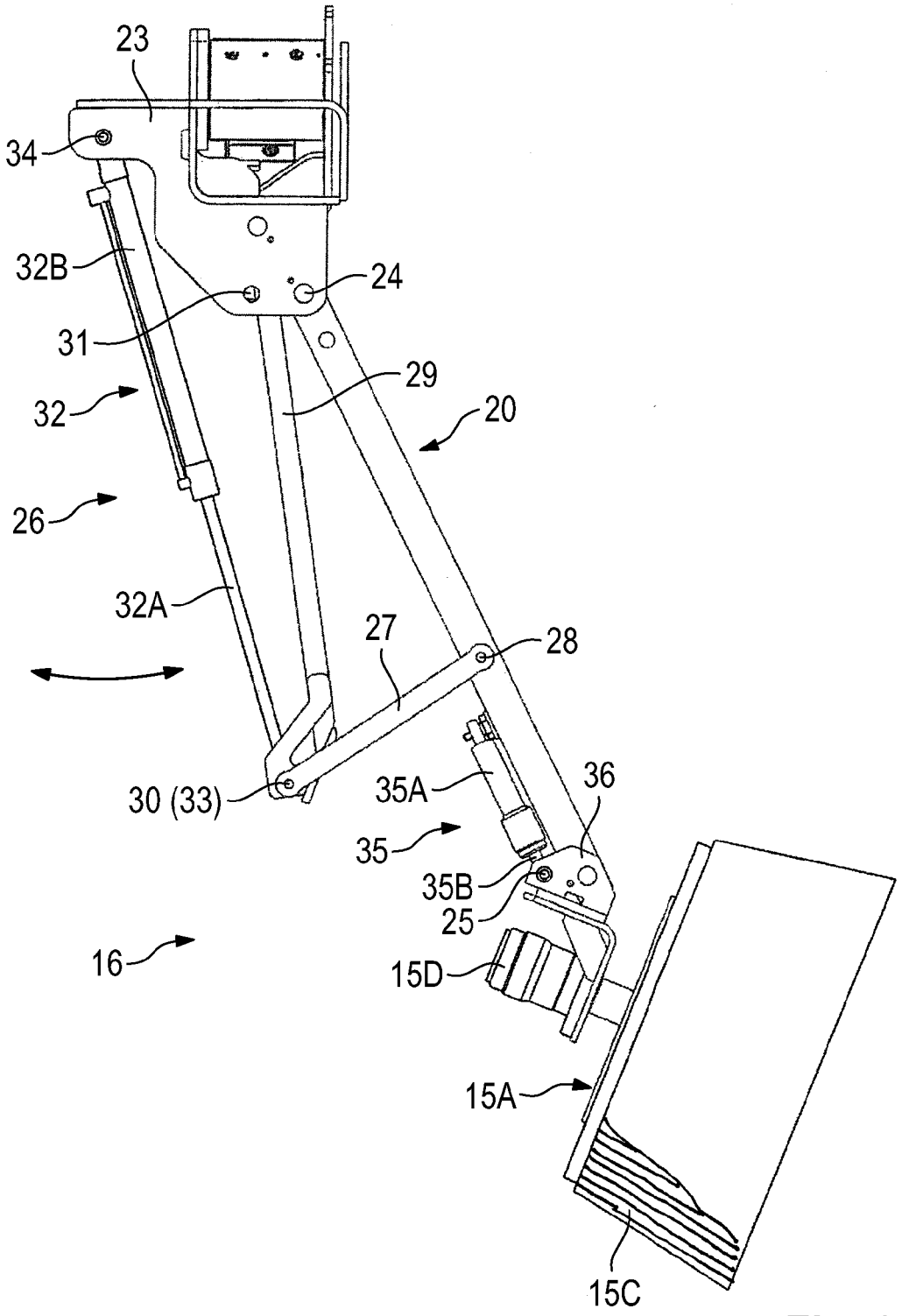
FIG. 6 is a side view of the cleaning device.
Figure 7:
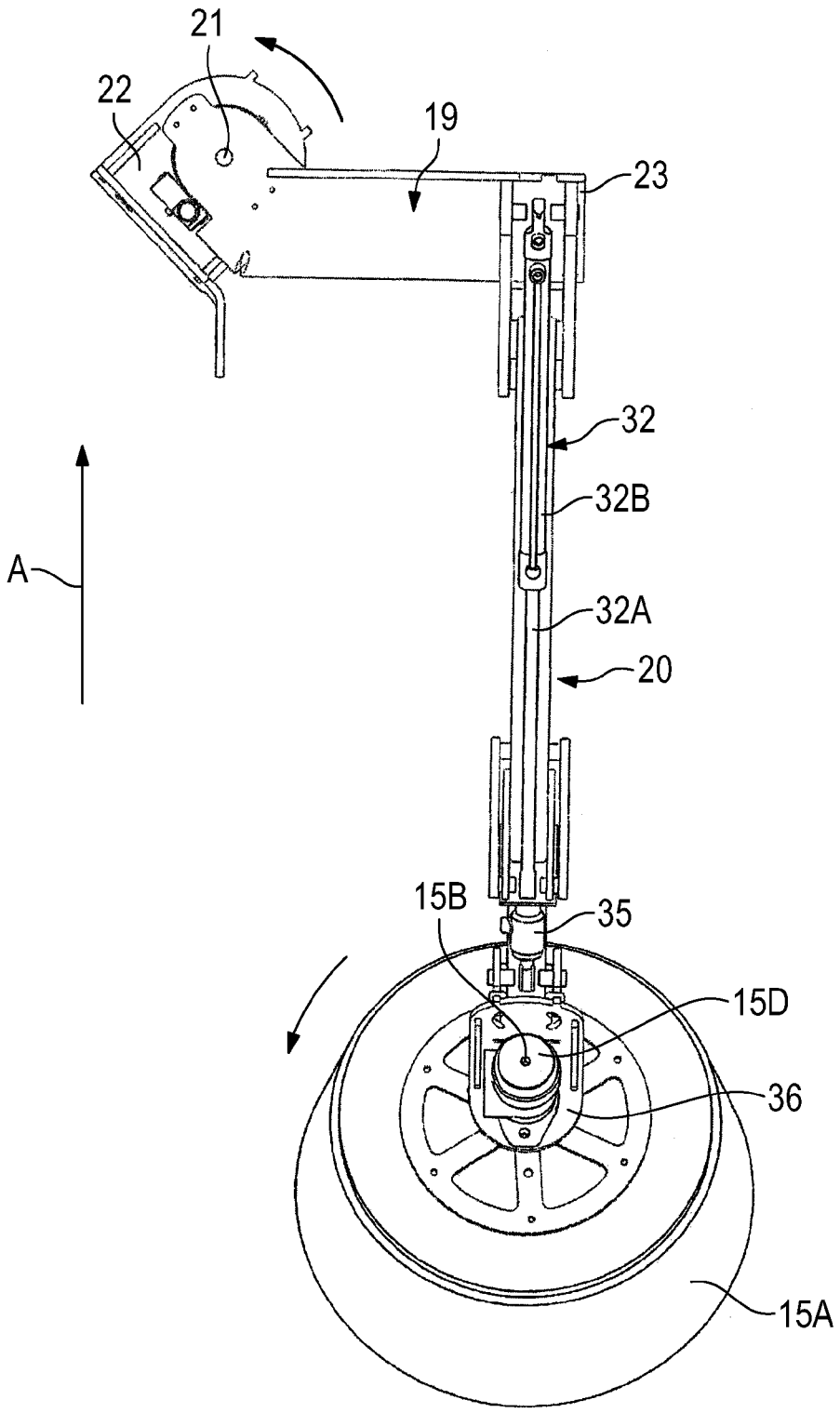
FIG. 7 is a plan view of the cleaning device, wherein the cleaning unit is pivoted backwards in the working direction.
Figure 8:
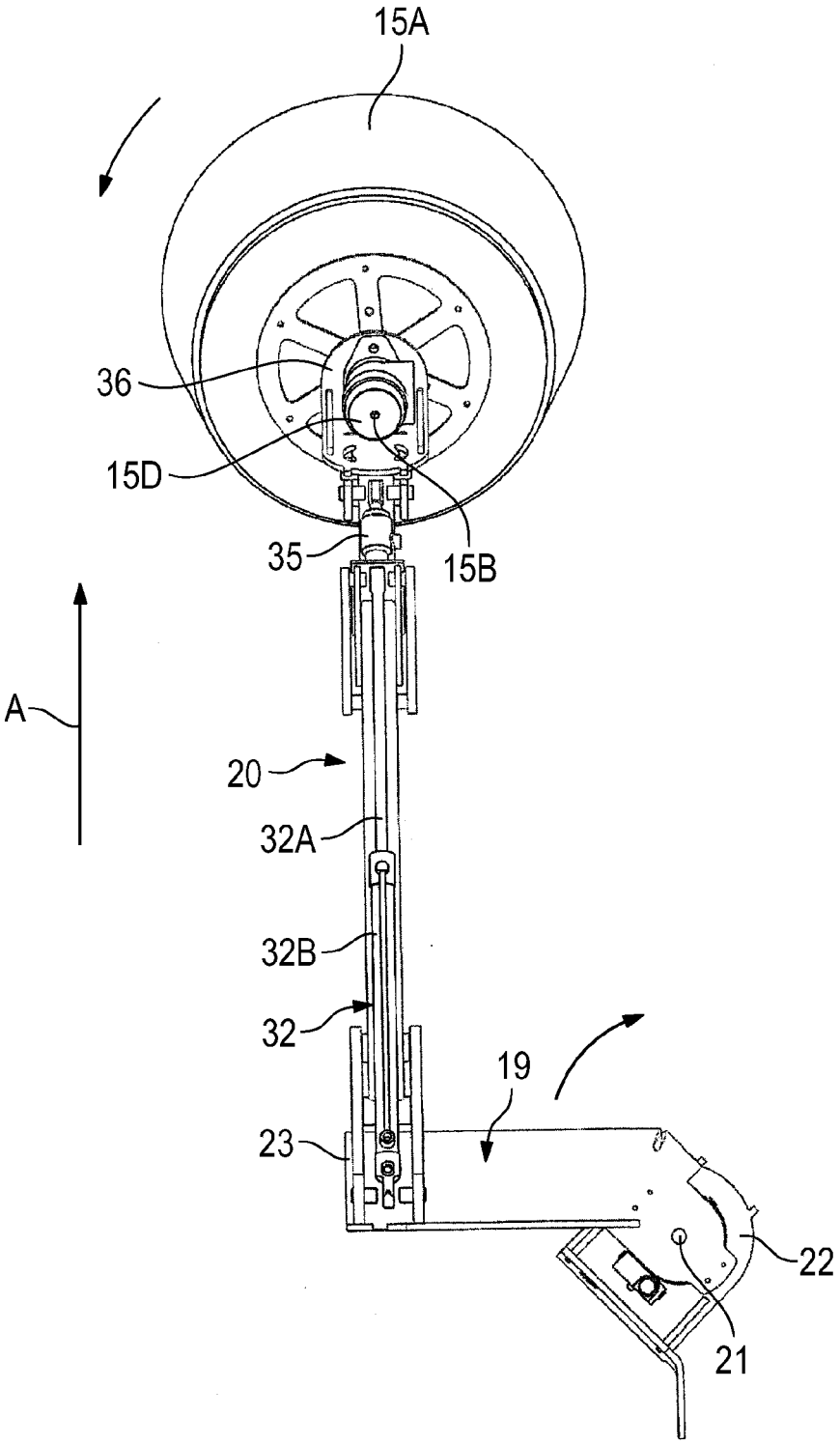
FIG. 8 is a plan view of the cleaning device, wherein the cleaning unit is pivoted forwards in the working direction.

The cleaning device 14 is described in detail with reference to FIGS. 6 to 8. The pivot device 16 of the cleaning device 14 comprises two pivot arms 19, 20. The first end of the first pivot arm 19 is mounted on a first attachment part 22, which is attached to the front right-hand corner of the machine frame 1 or is integrally formed with the machine frame, such that it can pivot about a vertical axis 21. The movement of the first pivot arm 19 in a horizontal plane allows for a pivot movement of the cleaning unit 15 either on the outside (FIG. 2) or the inside (FIG. 3). The first end of the second pivot arm 20 is attached to a second attachment part 23, which is arranged on the second end of the first pivot arm 19, such that it can pivot about a horizontal axis 24. The second attachment part 23 can either be integral with the pivot arm or can be a part fastened to the pivot arm. The movement of the second pivot arm 20 in a vertical plane allows for the cleaning unit 15 to fold upwards (FIGS. 4 and 5) or downwards (FIGS. 2 and 3) in the working direction A. Together with the disc brush 15A, the cleaning unit 15 is mounted on the second end of the second pivot arm 20 so that it can pivot about a horizontal axis 25. The disc brush 15A is used in the rear or front position such that the front region thereof contacts the ground. In this case, the disc brush 15A is pushed in the working direction A. The disc brush 15A comprises bristles 15C preferably made of polypropylene PP. The disc brush 15A is driven by a hydraulic motor 15D which sits above the brush.

In order to achieve a pivot movement that is as uniform as possible when unfolding the second pivot arm 20, the pivot device 16 comprises a lever mechanism 26. The lever mechanism 26 comprises a first steering arm 27, the first end of which is connected to a central portion of the second pivot arm 20 such that it can rotate about a horizontal axis 28. A second steering arm 29 is connected to the second end of the first steering arm 27 such that it can rotate about a horizontal axis 30, the second end of which second steering arm is in turn connected to the second attachment part 23 such that it can rotate about a horizontal axis 31. The lever mechanism 26 is actuated by means of a first piston/cylinder arrangement 32, the piston 32A of which is connected to the second end of the first steering arm 27 and to the first end of the second steering arm 29 such that it can rotate about a horizontal axis 33, and the cylinder 32B of which is connected to the second attachment part 23 such that it can rotate about a horizontal axis 34. By retracting and extending the first piston/cylinder arrangement 32, the cleaning unit 15 can be raised or lowered (FIG. 6). The lever mechanism 26 may be referred to as a lever assembly 26. The first and second steering arms 27 and 29 may also be referred to as first and second lever arms 27 and 29.

The work angle of the disc brush 15A can be set by means of a second piston/cylinder arrangement 35, the cylinder 35A of which is linked to the second pivot arm 20 and the piston 35B of which is linked to a lever arm 36 which is connected to the second end of the second pivot arm 20 in an articulated manner.

The invention claimed is:

1. A self-propelled civil engineering machine, comprising:

a machine frame;

at least two rear ground engaging supports and at least one front ground engaging support configured to support the machine frame from a ground surface, at least one of the rear ground engaging supports being a movable rear ground engaging support movable into an inner support working position in relation to a longitudinal side of the machine frame and into an outer support working position in relation to the longitudinal side of the machine frame;

a working roller arranged between the rear ground engaging supports; and a cleaning assembly including a cleaning tool arranged in front of the working roller in a working direction, the cleaning unit being configured to remove material from a portion of the ground surface over which the movable rear ground engaging support will travel in at least the outer support working position.

2. The machine of claim 1, wherein the cleaning tool comprises a sweeping tool.

3. The machine of claim 2, wherein the sweeping tool has a working width at least as wide as the movable rear ground engaging support.

4. The machine of claim 2, wherein the sweeping tool comprises a disc brush.

5. The machine of claim 4, wherein:

the cleaning assembly includes a pivot assembly configured such that a work angle of the disc brush can be adjusted about at least one axis.

6. The machine of claim 1, further comprising:

lifting mechanisms connecting the rear ground engaging supports to the machine frame so that a height of the rear ground engaging supports can be adjusted relative to the machine frame.

7. A self-propelled civil engineering machine, comprising:

a machine frame;

at least two rear ground engaging supports and at least one front ground engaging support configured to support the machine frame from a ground surface, at least one of the rear ground engaging supports being a movable rear ground engaging support movable into an inner support working position in relation to a longitudinal side of the machine frame and into an outer support working position in relation to the longitudinal side of the machine frame;

a working roller arranged between the rear ground engaging supports; and a cleaning assembly including a cleaning tool arranged in front of the working roller in a working direction;

wherein the cleaning assembly includes a pivot assembly configured such that the cleaning tool can be moved into an inner tool working position in relation to the longitudinal side of the machine frame and into an outer tool working position in relation to the longitudinal side of the machine frame.

8. The machine of claim 7, wherein:

the pivot assembly is configured such that when the cleaning tool is in the inner tool working position or the outer tool working position, the cleaning tool is substantially arranged on a same track as the at least one movable rear ground engaging support in its inner support working position or outer support working position, respectively.

9. The machine of claim 7, wherein:

the pivot assembly is configured such that in the outer tool working position the cleaning tool is arranged in the working direction between the at least one front ground engaging support and the rear ground engaging supports.

10. The machine of claim 7, wherein:

the pivot assembly is configured such that in the inner tool working position the cleaning tool is arranged in the working direction in front of the at least one front ground engaging support.

11. The machine of claim 7, wherein:

the pivot assembly is configured such that in the inner and outer tool working positions the cleaning tool is floatingly mounted such that the cleaning tool rests on the ground surface with a predetermined contact force.

12. The machine of claim 7, wherein:

the pivot assembly is configured such that the cleaning tool can be moved into an idle position in which the cleaning tool does not rest on the ground surface.

13. A self-propelled civil engineering machine, comprising:

a machine frame;

at least two rear ground engaging supports and at least one front ground engaging support configured to support the machine frame from a ground surface, at least one of the rear ground engaging supports being a movable rear ground engaging support movable into an inner support working position in relation to a longitudinal side of the machine frame and into an outer support working position in relation to the longitudinal side of the machine frame;

a working roller arranged between the rear ground engaging supports; and a cleaning assembly including a disc brush arranged in front of the working roller in a working direction;

wherein:

the movable rear ground engaging support is a right rear ground engaging support; and the cleaning assembly includes a pivot assembly configured such that:

the disc brush can be moved into an outer tool working position on a right-hand side of the machine frame, and relative to the working direction behind the at least one front ground engaging support and in front of the rear ground engaging supports, the disc brush being rotatably driven counter-clockwise; and the disc brush can be moved into an inner tool working position on a right-hand side of a longitudinal axis of the machine frame, and relative to the working direction in front of the at least one front ground engaging support, the disc brush being rotatably driven counter-clockwise.

14. A self-propelled civil engineering machine, comprising:

a machine frame;

at least two rear ground engaging supports and at least one front ground engaging support configured to support the machine frame from a ground surface, at least one of the rear ground engaging supports being a movable rear ground engaging support movable into an inner support working position in relation to a longitudinal side of the machine frame and into an outer support working position in relation to the longitudinal side of the machine frame;

a working roller arranged between the rear ground engaging supports; and a cleaning assembly including a cleaning tool arranged in front of the working roller in a working direction;

wherein:

the cleaning assembly includes a pivot assembly including:

a first pivot arm pivotally connected to the machine frame such that the first pivot arm can pivot relative to the machine frame about a vertical axis;

a second pivot arm pivotally connected to the first pivot arm such that the second pivot arm can pivot relative to the first pivot arm about a first horizontal axis; and wherein the cleaning tool is pivotally connected to the second pivot arm such that the cleaning tool can pivot relative to the second pivot arm about a second horizontal axis.

15. The machine of claim 14, wherein:

the pivot assembly further includes a lever assembly, the lever assembly including:

first and second lever arms, the first lever arm being rotatably connected to the second pivot arm and to the second lever arm, the second lever arm also being rotatably connected to the first pivot arm; and a piston and cylinder arrangement including a first end rotatably connected to both the first and second lever arms, and a second end rotatably connected to the first pivot arm.

* * * * *